US005107179A

United States Patent [19]

Vidovich

[11] Patent Number: 5,107,179

[45] Date of Patent: Apr. 21, 1992

[54] METHOD AND APPARATUS FOR MAGNETIC FIELD SUPPRESSION USING INDUCTIVE RESONANT AND NON-RESONANT PASSIVE LOOPS

[75] Inventor: Nikola Vidovich, San Jose, Calif.

[73] Assignee: Sun Microsystems, Inc., Mountain View, Calif.

[21] Appl. No.: 602,348

[22] Filed: Oct. 22, 1990

[51] Int. Cl.[5] ..... H01J 29/06

[52] U.S. Cl. ..... 315/8; 315/85; 335/214

[58] Field of Search ..... 315/85, 5, 8; 335/214, 335/219; 361/149, 150

[56] References Cited

U.S. PATENT DOCUMENTS 4,634,930 1/1987 Toshiyasu et al. ..... 315/8
4,940,920 7/1990 Giannantonio et al. ..... 315/8
4,947,083 8/1990 Bosch et al. ..... 315/85 X

*Primary Examiner*—Eugene R. LaRoche
*Assistant Examiner*—Ali Neyzari
*Attorney, Agent, or Firm*—Blakely Sokoloff Taylor & Zafman

[57] ABSTRACT

The present invention provides an apparatus and methods to reduce the stray magnetic fields created by the yoke assembly of a cathode ray tube (CRT) visual display device, and emitted from the CRT enclosure. A pair of closed wire loops are brought into contact with the yoke at the point where maximum magnetic radiation is emitted. The magnetic flux emitted from the yoke is coupled into the wire loop pair, inducing therein a current which flows so as to produce an opposing magnetic field to that produced by the CRT yoke. A capacitor in series in the second loop serves to increase the magnitude of the magnetic field produced by the second loop. Measured at a distance, the counteracting magnetic field reduces the total magnetic field emitted from the CRT enclosure.

6 Claims, 2 Drawing Sheets

LEGEND

YOKE MAGNETIC FLUX ————————

PASSIVELY INDUCED MAGNETIC FLUX — — — — — —

METHOD AND APPARATUS FOR MAGNETIC FIELD SUPPRESSION USING INDUCTIVE RESONANT AND NON-RESONANT PASSIVE LOOPS

BACKGROUND OF THE INVENTION

1. Field of the Invention

The present invention relates to an apparatus and methods for reducing the stray magnetic fields created by a cathode ray tube (CRT) visual display, and, in particular, to apparatus and methods for passively inducing an opposing magnetic field to reduce the stray magnetic field emitted from a CRT enclosure.

2. Art Background

CRTs are commonly used in televisions and in connection with computers as visual display devices. As is well known in the field, the CRT operates by producing a beam of electrons, which is then scanned across a fluorescent screen. The scanning of the electron beam is accomplished by a deflection circuit controlling an electro-magnet known as the yoke. The yoke surrounds the CRT just before the CRT flares out to form the enlarged portion of the CRT containing the fluorescent screen. When an electric current is passed through the conductive windings in the yoke, a magnetic field is created which will deflect the electron beam as the beam passes through the yoke region. By controlling the current in the yoke windings, the electron beam may be deflected in any desired direction, and thus scanned over the CRT screen to produce an image. However, in addition to creating the magnetic field necessary to scan the electron beam, the yoke creates a wide ranging stray magnetic field. This stray field, although not affecting the CRT whose yoke created the field, can deleteriously affect other CRTs or instruments sensitive to magnetic fields.

At present, a common method to reduce the stray magnetic fields produced by the yoke is to add bucking coils in series with the yoke. These coils, also known as compensating coils, are physically formed so as to produce a magnetic field to oppose the magnetic field produced by the yoke. Although the total magnetic field outside of the CRT enclosure in fact is diminished, several disadvantages become apparent. First, the current necessary to create a functional compensating magnetic field reduces the efficiency of the entire deflection circuit. In a typical compensation case, the bucking coil current typically is of the order of fifteen amperes, requiring a large power supply. Second, in order to supply the bucking coils with sufficient current to form a compensating field while in series configuration with the yoke, the deflection voltage on the yoke itself must be increased, which affects CRT picture quality. Third, because the bucking coils are in series with the yoke, any change in the bucking circuit can directly affect the CRT picture quality. And fourth, magnetic suppression by the bucking coils may inadequately prevent magnetic radiation emission from CRT enclosures, particularly in radiation sensitive applications.

In view of the foregoing, one objective of the present invention is provide an uncomplicated apparatus for, and method of, reducing the stray magnetic fields emitted from CRT enclosures.

Another objective of the present invention is to provide a less costly apparatus for, and method of, reducing CRT stray magnetic fields. Using the teachings of the present invention, a compensation circuit is available at significant savings compared to prior art embodiments.

Yet another objective is to disclose a more effective apparatus for, and method of, reducing CRT stray magnetic fields. As taught by the present invention, CRT stray magnetic fields are suppressed more effectively than using the teachings of the prior art. Moreover, suppression profiles can be optimized for particular environments.

SUMMARY OF THE INVENTION

The present invention provides an apparatus and methods to reduce the stray magnetic fields emitted from a cathode ray tube (CRT) visual display device created by the CRT yoke assembly. A pair of closed wire loops are brought into contact with the yoke at the point where maximum magnetic radiation is emitted. The first loop, in close proximity to the CRT, circumferentially extends to the sides of the CRT enclosure and to the top edge of the CRT display face. The second loop, also in close proximity to the CRT, circumferentially extends to the sides and rear of the CRT enclosure. The magnetic flux emitted from the yoke is coupled into the wire loop pair, inducing therein a current which flows so as to produce an opposing magnetic field to that produced by the CRT yoke. A capacitor in series in the second loop serves to create a resonant circuit to increase the current flow in the second loop. Measured at a distance, the counteracting magnetic field reduces the total magnetic field emitted from the CRT enclosure.

DETAILED DESCRIPTION OF THE INVENTION

An improved apparatus for, and method of, compensating against stray magnetic fields emitted from cathode ray tube (CRT) visual display devices are disclosed. In the description which follows, the CRT, yoke, and deflection circuitry will be shown and described in simple diagramatic form, in that these elements are well known in the art, and remain unaltered in the present invention.

Figure 1:
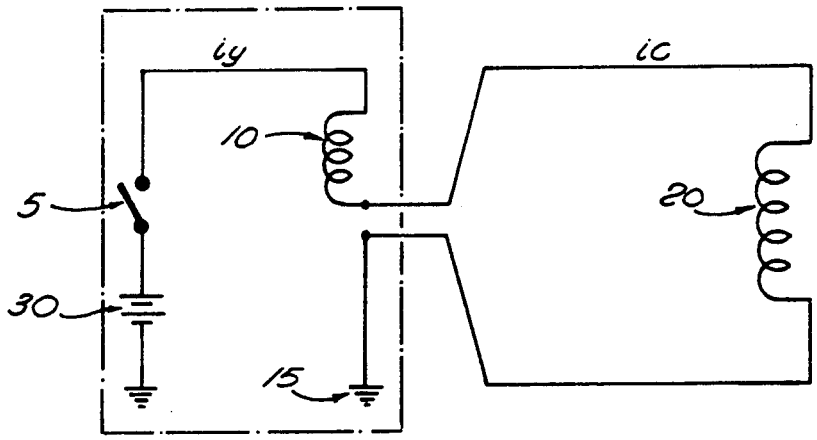
FIG. 1 PRIOR ART
FIG. 1 illustrates the prior art method of compensating yoke induced stray magnetic fields.

In FIG. 1, an electrical circuit representing the prior art is disclosed, wherein a compensating magnetic field is actively created to oppose the magnetic field created by a CRT deflection yoke assembly 10. Yoke 10 consists of a ferromagnetic ring or annulus, around which is wound a number of loops of conducting wire, and which is physically positioned on the CRT, in a configuration well known in the art (not shown). Following yoke 10, and in series configuration with it, are a number of bucking coils 20. A power supply 30 which drives the scanning function is connected to the yoke assembly 10 via an electronic switch 5. The circuit is completed to ground 15. During operation of the CRT, current $i_y$ from the power supply 30 flows through the windings of yoke 10 so as to create a deflecting magnetic field (not shown). The yoke-created magnetic field then bends the electron beam (not shown) in the desired direction at the desired time as the beam passes through the yoke region. Although the bending magnetic field is concentrated within the annular region of yoke 10, a stray field extends beyond the yoke in all directions. To compensate for the stray magnetic field, bucking coils 20 are physically located above and below yoke 10. The deflection power supply 30 connected to yoke 10 is also series connected to bucking coils 20. In series, current $i_y$ through yoke 10 equals current $i_c$ through bucking coils 20. Bucking coils 20 are physically formed so that when current $i_c$ flows through bucking coils 20, a magnetic field is created opposite in sense to that created by yoke 10. In the configuration shown in FIG. 1, current, $i_c$ typically amounts to 15 amperes peak-to-peak, at a typical deflection voltage of 1000 volts peak-to-peak.

As will be described in more detail below, the subject invention eliminates the high-power inefficient active circuit illustrated in FIG. 1 to reduce the stray magnetic fields emitted from the CRT enclosure, by using a simple pair of inductively coupled passive wire loops to create a magnetic field opposite to the yoke-induced field.

Figure 2:
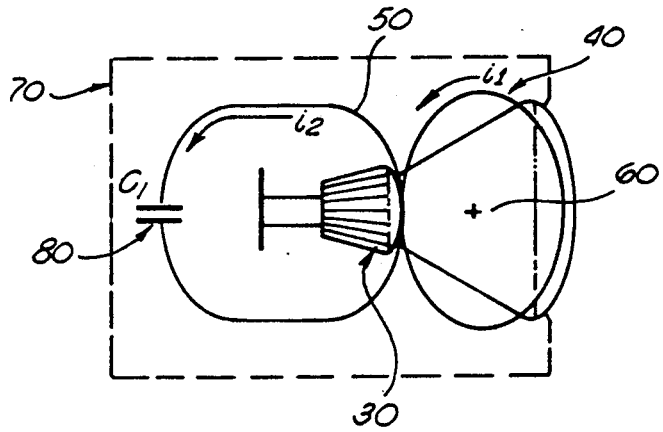
FIG. 2 illustrates in plain view the elements and physical layout of the compensation apparatus as taught by the current invention.

FIG. 2 illustrates in top plan view a CRT visual display employing the teachings of the present invention. A deflection yoke 30 surrounds a CRT 60 as is known in the prior art. The invention consists of two electrically insulated conducting loops (40 and 50) which induce an electrical current so as to produce a opposing magnetic field. In the preferred embodiment the electrically insulated conducting loops consist of two wire loops. However, one skilled in the art would recognize that there are other possible embodiments such as a printed circuit board tracing. In the preferred embodiment, a front loop 40 and a back loop 50 are placed above a CRT 60 and in close proximity therewith. The entire apparatus is housed within an enclosure 70. Attention is now directed for the moment to front loop 40. Front loop 40 is formed into a generally circular shape, and is then brought into tangential contact with the front of yoke 30. The precise point of contact is where the front face of yoke 30 contacts the glass envelope of CRT 60. From the yoke-to-glass interface, front loop 40 then circumferentially extends laterally to the sides of enclosure 70, and forward to the top edge of the CRT 60 where the image screen of CRT 60 contacts enclosure 70. As will be shown more clearly in FIG. 3, front loop 40 also follows the profile of CRT 60, as CRT 60 transitions from the smaller diameter of the electron beam source to the larger diameter of the CRT screen. In operating CRT 60, yoke 30 acts as a transformer: the changing magnetic field created by yoke 30 induces an electric field, which passively causes an induced current $i_1$ to flow in front loop 40. A maximum inducted current $i_1$ in front loop 40 is ensured by the tangential placement of front loop 40 at the yoke-to glass interface, where stray magnetic radiation is at a maximum. However, in accordance with conservation of energy principles, the induced current $i_1$ flows to oppose the magnetic field creating it. Moreover, the flow of electrons in front loop 40 comprising induced current $i_1$ itself creates a loop-induced magnetic field. The loop-induced magnetic field created by the opposing induced current $i_1$ therefore is opposite in sense to the magnetic field created by yoke 30. The passive loop-induced opposing magnetic field subtracts from the actively created yoke-field at distant points, resulting in a reduced total magnetic field emitted from CRT enclosure 70.

Still referring to FIG. 2, attention is now directed to back loop 50. Back loop 50 is formed into a generally rectangular shape, and is brought into tangential contact with yoke 30 at precisely the same point as front loop 40, namely where the front face of yoke 30 contacts the glass envelope of CRT 60. From its tangential contact point, back loop 50 then generally follows the perimeter of CRT enclosure 70, extending laterally to both sides and then rearward to the rear of enclosure 70. As in the case of front loop 40, yoke 30 acts as a transformer: the changing magnetic field created by yoke 30 inducts an electric field, which passively causes an induced current $i_2$ to flow in back loop 50. Again, as in the case of front loop 40, a maximum induced current $i_2$ in back loop 50 is ensured by the tangential placement of back loop 50 at the yoke-to-glass interface, where stray magnetic radiation is at a maximum. However, in accordance with conservation of energy principles, the induced current $i_2$ flows to oppose the magnetic field creating it. Moreover, the flow of electrons comprising induced current $i_2$ in turn creates a back loop-induced magnetic field. The loop-induced magnetic field created by the opposing induced current $i_2$ is therefore opposite in sense to the magnetic field created by yoke 30. Thus, the passive loop-induced opposing magnetic field subtracts from the actively created yoke-field at distant points, again resulting in a reduced total magnetic field emitted from CRT enclosure 70.

Thus, it is noted that front loop 40 and back loop 50 passively create magnetic fields which, in concert, reduce the total magnetic field emitted from CRT enclosure 70. In the case of back loop 50 only, a capacitor 80 is added in series to increase the magnitude of induced current $i_2$, the amplification being achieved by forming a near-resonant "LC" type circuit at the particular deflection frequency of CRT 60. In the present embodiment, a capacitor 80 with a capacitance of 3.5 microfarad increases the induced back loop current $i_2$ flowing in back loop 50 from 3 amperes to approximately 15 amperes, thereby more effectively reducing the stray field to the rear of CRT 60.

Unlike the compensation methods and circuits used in the prior art (FIG. 1), neither front loop 40 nor back loop 50 in FIG. 2 are electrically coupled to the deflection circuitry. Rather, both are magnetically coupled to the deflection circuit at the yoke 30, with yoke 30 acting as a transformer. Front loop 40 and back loop 50 function simply according to Faraday's and Lenz's Laws: (i) currents $i_1$ and $i_2$ are passively induced by the electric field produced by the changing stray magnetic field, and (ii) induced currents $i_1$ and $i_2$ flow to oppose the changing stray field, thereby creating opposing magnetic fields which subtract from the yoke-created stray field. Accordingly, it will be appreciated that the advantage of the present invention is that a reduced total magnetic field is emitted from the CRT enclosure 70 without the use of active circuits. Moreover, it is seen that the reduced total magnetic field is accomplished without dependence upon the deflection circuit's, or any circuit's, power supply.

Figure 3:
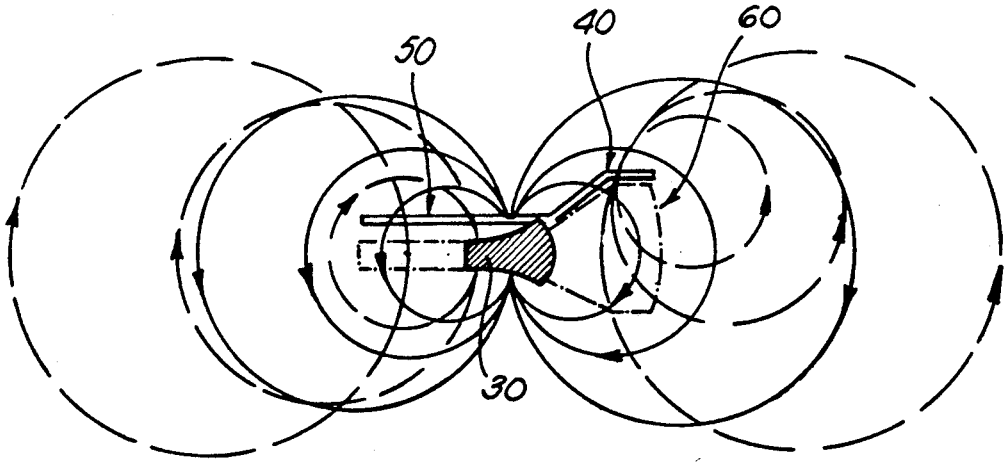
FIG. 3 illustrates in side elevation the layout of the compensation apparatus, including the compensating field created thereby.

Referring now to FIG. 3, a side elevation view is shown of the present invention in place above CRT 60.

The front loop 40 and back loop 50 are seen to traverse the length of CRT 60, tangentially contacting the front of a yoke 30 at the yoke-to-glass interface. FIG. 3 shows clearly the positioning of front loop 40 and back loop 50 in close proximity to CRT 60. In particular, attention is directed to the position of front loop 40 relative to CRT 60, as the profile of CRT 60 changes from the narrow diameter of the electron gun portion to the larger diameter of the display screen portion. It is seen that front loop 40 remains generally equidistant from CRT 60 throughout. The bend in front loop 40 permits it to pass over CRT 60 while projecting forward the passively induced opposing magnetic field. Still referring to FIG. 3, attention is now directed to the opposing magnetic fields which are formed during the operation of a CRT display device employing the teachings of the present invention. The magnetic field actively created by yoke 30 is shown by a solid line. The opposing magnetic field passively induced by front loop 40 and back loop 50 is shown by a dashed line.

Figure 4:
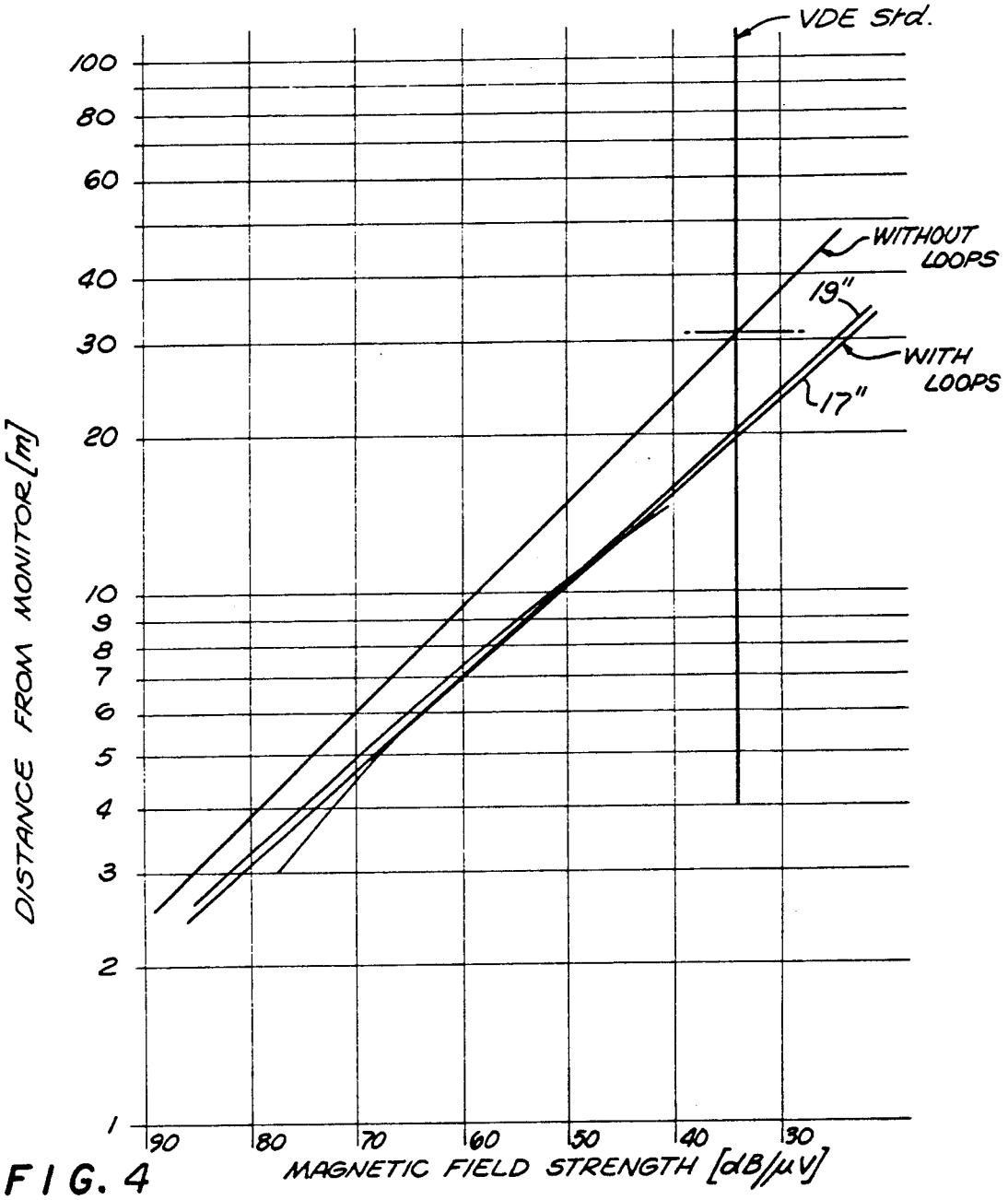
FIG. 4 is a plot of the magnetic field strength versus distance, showing the improved compensation performance by the present invention.

Turning now to FIG. 4, empirical total emitted magnetic field strength is plotted against distance for 17-and 19-inch CRT monitors equipped with the present invention. In FIG. 4, test monitors using the present invention are shown to satisfy the German VDE Agency specification of 34 dB/$\mu$V at 20 meters. A monitor using a standard prior art bucking coil circuit is not in compliance until 30 meters. Note that the passive loop suppression is independent of monitor size. Thus it will be appreciated that the cancellation of the yoke-induced field is more effective using the teachings of the present invention than prior art teachings.

Figure 5A:
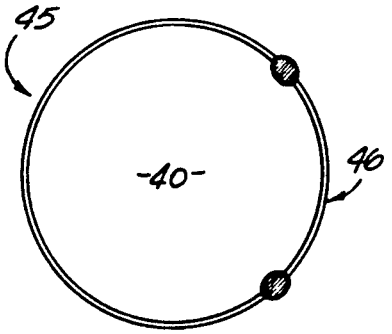
FIGS. 5A and 5B depict the construction of the two inductive loops.
Figure 5B:
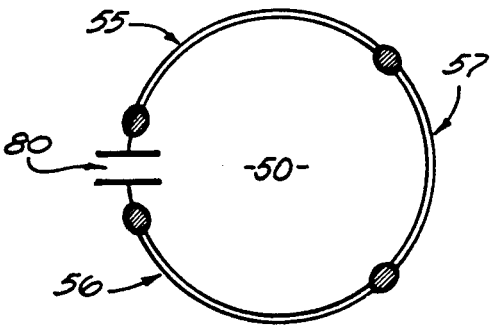

FIGS. 5A and 5B illustrate the preferred embodiment of front loop 40 and back loop 50 comprising the present invention applied to a 17-inch CRT monitor. In FIG. 5A, front loop 40 is shown to be constructed of two wire arcs of dissimilar diameter. Referring now to front loop 40, the larger circumference arc 45 is fashioned of a 32-inch length of 18 gauge wire, and projects laterally and forward from the yoke to the front of the CRT. The smaller circumference arc 46, fashioned of a 10-inch length of 22 gauge wire, is placed into the gap between the yoke (not shown) and the glass comprising CRT (not shown). Arcs 45 and 46 are fixedly coupled by any well-known joining method, such as crimping and soldering. Referring to FIG. 5B, back loop 50 is fashioned similarly, but the addition of capacitor 80 inserted into the loop necessarily requires three arcs. The larger circumference arc 55 and arc 56 are fashioned of two 16-inch lengths of 18 gauge wire, and together project from the yoke (not shown) laterally to the sides and to the rear of the CRT enclosure (not shown). The smaller circumference arc 57, as above, is fashioned of a 10-inch length of 22 gauge wire, and is placed into the gap between the yoke (not shown) and the glass comprising CRT (not shown), precisely where front loop 40 contacts the yoke (not shown). Back loop large circumference arcs 55 and 56, back loop small circumference arc 57, and capacitor 80 are fixedly coupled by the above joining method of crimping and soldering.

The foregoing has described (1) an electrical apparatus for simply, efficiently, and at minimal cost, reducing the stray magnetic fields emitted from CRT enclosures, and (2) a method for accomplishing such a reduction.

It is contemplated that changes and modifications may be made by one of ordinary skill in the art, to the materials and arrangements of elements of the present invention without departing from the spirit and scope of the invention.

I claim:

1. An electrical circuit for suppressing a stray magnetic field created by a cathode ray tube (CRT), the CRT having an annular yoke having a front face and contained within a CRT display enclosure, said circuit comprising:

a) a first electrically insulated conducting loop tangentially contacting the front face of said CRT yoke and magnetically coupled thereto, said first loop projecting laterally to the sides of said CRT enclosure and forward to the front of said CRT, said first loop further producing and induced magnetic field opposing that created by said CRT yoke;

b) a second electrically insulated conducting loop tangentially contacting the front face of said CRT yoke and magnetically coupled thereto, said second loop projecting laterally from said yoke to the sides and rearward to the back of said CRT enclosure, said second loop further producing an induced magnetic field opposing that created by said CRT yoke;

c) capacitance means coupled to said second loop for passively increasing induced current in said second loop; and d) means for supporting said first and second loop within said stray magnetic field, whereby said first and second conducting loops held within said stray magnetic field passively produce an opposing magnetic field to reduce said stray magnetic field emitted from said CRT display enclosure.

2. The electrical circuit as claimed in claim 1, where said capacitance means comprises a capacitor coupled in series with said second loop.

3. The electrical circuit as set forth in claim 2 wherein said capacitor has a capacitance such that said second loop forms a resonant circuit.

4. The electrical circuit as set forth in claim 2 wherein said capacitor has a capacitance of 3.5 microfarads.

5. A method of suppressing a stray magnetic field created by a cathode ray tube (CRT), said CRT having an annular yoke having a front face and contained within a CRT display enclosure, comprised of the following steps:

a) locating a first insulated conducting loop in a generally horizontal plane proximally above said CRT, said first loop tangentially contacting the intersection of the front face of said yoke to said CRT and magnetically coupled thereto;

b) locating a second insulated conducting loop in a generally horizontal plane proximally above the CRT, said second loop tangentially contacting the intersection of the front face of said yoke to said CRT and magnetically coupled thereto; and c) passively increasing said opposing magnetic field strength by using a capacitor within said second conducting loop to produce a substantially resonant circuit, whereby said first and second conducting loops in proximity to said stray magnetic field produce an opposing magnetic field to reduce said stray magnetic field emitted from said CRT display enclosure.

6. The method of claim 5 wherein said capacitor has a capacitance of 3.5 microfarads.

* * * * *